United States Patent [19]

Sullivan, 3rd et al.

[11] 4,028,268

[45] June 7, 1977

[54] HIGH TEMPERATURE CORROSION INHIBITOR

[75] Inventors: Daniel S. Sullivan, 3rd, Houston, Tex.; Charles E. Strubelt, Tamare, Venezuela; Kenneth W. Becker, Houston, Tex.

[73] Assignee: Exxon Research and Engineering Company, Linden, N.J.

[22] Filed: Dec. 3, 1975

[21] Appl. No.: 637,168

[52] U.S. Cl. ..... 252/392; 252/8.55 C; 252/390

[51] Int. Cl.[2] ..... C23F 11/04

[58] Field of Search ..... 252/8.55 C, 8.55 E, 252/148, 390, 392

[56] References Cited

UNITED STATES PATENTS

| | | | |
|---|---|---|---|
| 2,037,762 | 4/1936 | Cole | 252/148 |
| 2,814,593 | 11/1957 | Beiswanger et al. | 252/8.55 |
| 3,113,113 | 12/1963 | Marsh et al. | 252/148 X |
| 3,127,447 | 3/1964 | Jaruzelski et al. | 252/148 X |
| 3,696,048 | 10/1972 | Hausler et al. | 252/390 X |
| 3,779,935 | 12/1973 | McDougall et al. | 252/8.55 X |

*Primary Examiner*—Herbert B. Guynn
*Attorney, Agent, or Firm*—David A. Roth; C. Leon Kim

[57] ABSTRACT

Metal corrosion inhibiting compositions of outstanding utility are prepared by utilizing a selective and critical multicomponent formulation comprising in combination functionally operative proportions of

- a specific quaternized cyclic nitrogen base
- a specific acetylenic alcohol
- a surface active agent
- a formic acid derivative.

The above formulation can be substantially improved by adding certain functionally operative additional surfactants. The choice of these surfactants is unobvious and it has been found that only a few critically selective species are operable for the purposes of the invention.

22 Claims, No Drawings

HIGH TEMPERATURE CORROSION INHIBITOR

CROSS REFERENCE TO RELATED APPLICATIONS

This application is not related to any pending patent application or issued patent of these inventors.

BACKGROUND OF THE INVENTION

1. Field of the Invention

This invention relates to corrosion inhibitor compositions and is particularly concerned with multicomponent inhibitor formulations capable of protecting ferrous metals against attack by corrosive acids in high temperature environments.

2. Description of the Prior Art

The corrosion of oil field tubular goods and similar equipment by hydrochloric acid solutions and other corrosive materials used in well workover and stimulation operations is a longstanding problem in the petroleum industry. The use of inhibitors to combat such corrosion is conventional. The materials suggested in the past for use in such inhibitors include various acetylenic alcohols, fluorinated surfactants, quaternary derivatives of heterocyclic nitrogen bases and halomethylated aromatic compounds, formamides, and surface active agents, alone or in combination with other materials. U.S. Pat. No. 2,814,593, for instance, discloses compositions of this nature. Tests have shown that certain of these earlier compositions are reasonably effective for inhibiting the corrosion of ferrous metals in shallow wells where temperatures are relatively low and conditions are not severe. In deeper wells where temperatures of 300° F. or higher are apt to be encountered, it has been found that corrosion rates tend to be exceptionally high and that many of the compositions advocated for use in the past are inadequate. Efforts to develop improved inhibitors which will be effective under these more severe conditions have not heretofore been as promising as the compositions of the instant invention.

SUMMARY OF THE INVENTION

This invention comprehends a specific formulation of components for a corrosion inhibitor composition which is considerably more effective than inhibitors available in the past. In accordance with the invention, it has now been found that an inhibitor formulation which is suprisingly effective for the protection of ferrous metals against attack by corrosive acids at elevated temperatures can be prepared by blending at least four unique specially selected components which unexpectedly interact together to result in an outstanding corrosion inhibitor composition.

DESCRIPTION OF THE PREFERRED EMBODIMENTS

A. The Quaternized Cyclic Nitrogen Base and Polystyrenes

The quaternary compounds which have been found useful as one component for preparing the improved inhibitor composition of the invention are quaternary derivatives of quinoline and halomethylated polycyclic compounds selected from the group consisting of halomethylated polynuclear aromatics containing from 2 to 4 condensed aromatic rings per molecule, mixtures of such halomethylated polynuclear aromatics, and halomethylated polystyrene.

Polynuclear aromatics which can be halomethylated and employed for purposes of the invention include indane, indene, naphthalene, methyl naphthalene, anthracene, phenanthrene, acenaphthene, fluorene, xanthene, chrysene, pyrene and the like.

These compounds can be isolated and individually halomethylated if desired, but in most cases, it is preferred to employ mixed polynuclear aromatics derived from crude oil, petroleum fractions or coal tar.

Alternatively, petroleum fractions or other oils containing polynuclear aromatic compounds can be subjected to halomethylation, followed by recovery of the halomethylated product. Depending upon the particular oil selected, this latter procedure may result in the inclusion of some halomethylated single ring aromatic compounds, but the presence of such materials in reasonably small quantities is not ordinarily objectionable. Oils suitable for halomethylation to produce the mixed halomethylated products include aromatic solvents boiling within the range of about 200° and about 750° F. and similar petroleum fractions.

The polystyrenes which may be halomethylated and used in preparing the inhibitor compositions of the invention will normally be low molecular weight polymers. Polystyrenes having molecular weights in the range between about 100 and about 5000 are normally preferred and those with molecular weights between about 100 and about 500 are particularly effective for purposes of the invention.

The polynuclear aromatic compounds and polystrenes which are used in the preparation of the quaternary compounds employed as a component of the inhibitor blends of the invention can be halomethylated by treating them with a hydrogen halide gas in the presence of paraformaldehyde and anhydrous zinc chloride in a stirred reactor. The aromatic material, paraformaldehyde and zinc chloride are first charged to the reactor and then brought up to the reaction temperature of about 130° to about 150° C. while providing agitation. The hydrogen halide gas is then introduced into the reaction mixture at a rate which will permit control of the temperature. Upon completion of the reaction, the reaction mixture can be cooled, diluted with water, and then extracted with ether or a similar solvent to recover the halomethylated product. The solvent can then be removed by distillation. The product can then be washed to further purify it and then dried for use in preparing the quaternary compound. Other conventional halomethylation procedures can also be employed.

The quaternarization reaction of the halomethylated polycyclic material with quinoline or a similar heterocyclic nitrogen base is normally carried out in isopropanol, formamide or a similar solvent at a temperature between about 200° and about 250° F. After the reaction has been completed, the product can be cooled and diluted with additional solvent to produce a solution in a concentration suitable for use in preparing the inhibitor compositions of the invention. Concentrations on the order of about 40 to about 75% by weight are normally preferred. It will be understood, of course, that preparation of the quaternary derivatives employed is not restricted to this particular process and that other conventional quaternarization processes may be used.

B. Specific Acetylenic Alcohol

The acetylenic alcohols employed in the improved inhibitor compositions are aliphatic alcohols which contain from 3 to about 10 carbon atoms per molecule and have the general formula:

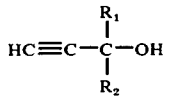

where $R_1$ is selected from the group consisting of the hydrogen atom and the methyl group and $R_2$ is selected from the group consisting of the hydrogen atom and alkyl groups containing up to about 7 carbon atoms. Suitable acetylenic alcohols of this type include propargyl alcohol, 1-butyn-3-ol, 3-methyl-1-butyn-3-ol, 1-pentyn-3-ol, 3-methyl-1-penetyn-3-ol, 1-hexyn-3-ol, 3-methyl-1-hexyn-3-ol, 1-octyn-3-ol, hexyne-1-ol-3, hexyne-1-methyl-3-ol-3,4-ethyl-1-octyn-3-ol and the like. The use of mixtures containing two or more such alcohols is generally preferred. Alcohols of this type and such mixtures are available commercially.

C. The Surface Active Agent

A variety of different surface active agents can be employed in the compositions of the invention. The surface active agent serves as a dispersing material and wetting agent and aids in reducing the amount of pitting which takes place. The preferred surface active agent is a nonionic ethylene oxide adduct of a primary amine having the structural formula:

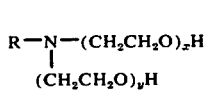

where R is $C_5$ to $C_{50}$ alkyl group, preferably an aliphatic or substituted aliphatic chain containing from about 12 to about 18 carbon atoms and $x$ and $y$ are numbers ranging from 1 to 20, preferably between 1 and about 4. The preferred compounds are those which contain aliphatic groups derived from naturally occurring materials such as tallow, coconut oil and soybean oil and which contain from 1 to 3 ethylene oxide groups in each of the ethylene oxide chains attached to the nitrogen atom. Compounds which are particularly effective for purposes of the invention include those having the following structural formulas:

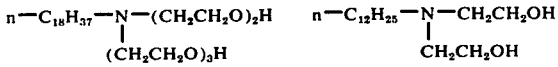

As indicated earlier, the invention is not restricted to the particular surface active agents described above and can instead be practiced with a variety of other surfactants. Representative materials which can be used include aliphatic primary amines containing from about 12 to 18 carbon atoms per molecule, secondary amines containing a methyl group and a $C_{12}$ to $C_{18}$ alkyl group, tertiary amines containing two methyl groups and a $C_{12}$ to $C_{18}$ alkyl group, $C_{12}$ to $C_{18}$ alkyltrimethylammonium chlorides, polyethoxylated ethers of aliphatic alcohols, polyethoxylated esters of fatty acids, polyethylene oxide adducts of alkyl phenols, tall oils, and the like. A variety of such surface active agents which will be suitable for purposes of the invention are available commercially and will be familiar to those skilled in the art.

C(1). The Supplemental Surface Active Agent

Regardless of the particular surface active agent utilized as described above, an additional important improvement facet of this invention resides in the use of a special supplemental surface active agent in the formulation.

The supplemental agent is a lauryl alcohol derivative of ethylene oxide with about 20 to 23 moles of ethylene oxide forming the polyether adduct of the alcohol.

A preferred supplemental agent is available commercially as BR1J-35 from Atlas Chemical Company.

It is used in quantities of from 6 to 14, preferably 8 to 12, and most preferably 9 to 11 weight percent based on the total weight of the active components of the four major component formulation of the invention.

This supplemental agent plays an important role in commercial formulations, since it prevents precipitation of the formulation under adverse field conditions.

Precipitation is undesirable since it causes cleaning problems for field equipment: tanks, tank trucks and the like.

D. The Formic Acid Derivatives

The formic acid derivatives which are employed in preparing the improved corrosion inhibitor formulations are compounds having the formula:

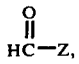

where Z is chosen from the group consisting of an alkoxy group containing from about 1 to about 4 carbon atoms, an amino radical, or an alkyl-substituted amino group containing from 1 to about 4 carbon atoms. Specific examples of such compounds include methylformate, ethylformate, butylformate, formamide, dimethylformamide, diethylformamide, and the like. Compounds of this type are commercially available from a variety of different sources. The use of formamide is normally preferred.

E. The Fluorinated Surfactant (Optional)

A typical fluorinated surfactant suitable for this invention is marketed commercially as FC-134, however many cationic fluorinated surfactants are suitable. Perfluoroalkylimidazolines can also be used.

F. Preparation Details

The improved inhibitor compositions of the invention are prepared by blending the constitutents in the disclosed concentrations in a vat or other vessel provided with a suitable agitator. Typical amounts of the various components are shown below:

| Constituent | Concentration |
|---|---|
| Quaternary derivative of quinoline and polycyclic aromatic compound | About 25 to about 60, preferably 30 to 50 weight percent |
| Acetylenic alcohol | About 5 to about 30, preferably 8 to 15 weight percent |
| Surface active agent | About 0.01 to about 15, preferably 1 to 5 weight percent |
| Formic acid derivative | About 30 to about 75, |

-continued

| Constituent | Concentration |
|---|---|
| | preferably 40 to 60 weight percent |
| Fluorinated surfactant | 0 to about 1.0, preferably 0.05 to 0.8 weight percent |

The inhibitor compositions of the invention formulated as described above can be used in any of a variety of applications requiring the protection of ferrous metals against attack by corrosive acids but are particularly useful for inhibiting the corrosion of oil well tubular goods and similar equipment by hydrochloric acid and other acid solutions used in workover and stimulation operations for high temperature oil and gas wells. The inhibitor compositions of the invention are normally incorporated in such acid solutions in concentrations ranging from about 0.1 to about 5% by weight. The concentration selected for a particular application will depend in part upon the particular acid solution then used, the susceptibility of the tubular good or other ferrous material to corrosion by the acid, and the enviroment in which the acid is to be employed. Concentrations between about 0.5 and about 3% by weight are generally preferred.

The invention is further illustrated by the following examples.

EXAMPLE 1

In the first of a series of laboratory experiments, a reactor was charged with 123 g. of crude quinoline and 140 g. of 1-(chloromethyl)naphthalene. The contents of the reactor were stirred and the vessel was then heated to a temperature of 125° C. Following this, a small portion of a total 176 g. quantity of isopropyl alcohol was added to the reactor and refluxing of the reaction mixture was started in order to maintain the reaction mixture at the 125° C. temperature. This was continued for a period of about 3 hours, the temperature remaining relatively constant at about 125° C.

At the end of this period the reaction product was slowly cooled to room temperature and the remainder of the 176 g. of isopropyl alcohol was blended into the product. The result was an isopropyl alcohol solution containing 60% by weight of N-(1-naphthylmethyl)-quinolinium chloride. This quaternary derivative of quinoline and a halomethylated polynuclear aromatic compound is a useful species of one constituent of the improved corrosion inhibitor compositions of the invention.

EXAMPLE 2

A quaternary derivative of quinoline and phenanthrene was prepared by first charging 267.3 g. of phenanthrene, 82.5 g. of paraformaldehyde, 195 mm of glacial acetic acid, 124 mm of 85% phosphoric acid and 321 g. of concentrated hydrochloric acid into a 2-liter reaction vessel fitted with a thermometer, an agitator and a reflux condenser. The reaction mixture was then heated to a temperature between 80° and 85° C. and maintained at that temperature with agitation for a period of 6 hours. At the end of this period, ice and about 500 ml of water were added to the reaction mixture to cool it. After the material had reached room temperature, about 500 ml of methylene chloride was added to the mixture to extract soluble organic constituents and the materials were transferred to a separatory funnel.

The heavier methylene chloride layer was separated from the lighter materials, washed with water, washed twice with a dilute potassium carbonate solution and then again washed with water. The resultant solution was then dried by adding magnesium sulfate and filtered. Following the filtration step, the methylene chloride was removed by distillation. Vacuum distillation of the residue yielded 137 g. of a yellow solid which boiled between 181° C. and 225° C. at a pressure of between 1 and 2 mm of mercury.

Upon recrystallization of this material from ether and hexane, 117 g. of a yellow solid was recovered. Elemental analysis showed a chlorine content of from 9.40 to 9.63% by weight, compared to a theoretical value of 15.64%. The product was then subjected to nuclear magnetic resonance analysis and infrared analysis. Both indicated that ring chloromethylation had occurred and that the product was impure chloromethylphenanthrene.

90 g. of the chloromethylphenanthrene prepared above was placed in a reaction vessel, along with 61.5 g. of crude quinoline. The resulting mixture was then stirred and heated to a temperature of 125° C. A total of 101 g. of isopropanol was weighed out and a portion of this was added to the reaction mixture to permit temperature maintenance of the reaction mixture by refluxing of the isopropanol portion. After the mixture had been held at 125° C. temperature for about 3 hours, the material was cooled to room temperature and the remainder of the isopropanol was added. This resulted in a 60% isopropanol solution of N-(phenanthrylmethyl) quinolinium chloride.

EXAMPLE 3

A 250 ml reaction flask was equipped with a thermometer, a stirring device, a reflux condenser and a gas inlet tube. This reactor was charged with 104.14 g. of a polystyrene having a molecular weight of about 250. The material used is marketed by Pennsylvania Industrial Chemicals, Inc. under the tradename of "Piccolastic AL". To this were added 30.3 g. of paraformaldehyde and 30.0 g. of anhydrous zinc chloride.

The resulting mixture was stirred vigorously and then heated to a temperature of 60° C. A stream of hydrogen chloride gas was added through the gas inlet tube at a rate determined by the exothermic heat of reaction. The total reaction time was about 45 minutes. The reaction mixture was then cooled and about 500 ml. of water were added.

Following this, the product was extracted with about 200 ml. of ether and the ether extract was washed twice with 500 ml. of water, once with 500 ml. of saturated sodium bicarbonate, and two more times with water. This extract was then dried twice over magnesium sulfate.

The dried extract was placed in a still and heated to a maximum hot temperature of 128° C. The highest vapor temperature obtained was 38° C. The residue obtained was 94.5 g. of crude chloromethylated low molecular weight polystyrene. Elemental analysis showed the presence of 10.49 to 10.71% chlorine and nuclear magnetic resonance and infrared analysis confirmed that the ring structure had been chloromethylated.

The chloromethylated polystyrene prepared as described above was reacted with quinoline to form the quaternary derivatives by charging 84.5 g. of the chloromethylated polystyrene, 87 g. of crude quinoline and 85.5 g. of formamide into a reaction vessel, heating the reaction mixture to a temperature of 125° C., and maintaining it at that temperature for a period of 2.5 hours. Following this, the reaction product was cooled slowly to room temperature and 86.0 g. of additional formamide was added. This gave a formamide solution containing approximately 60% by weight of the quaternary derivatives of quinoline and chloromethylated polystyrene.

EXAMPLE 4

A heavy aromatic petroleum fraction having a flash point of about 150° F. and consisting primarily of $C_9$ to $C_{12}$ aromatic hydrocarbons was charged into a reaction vessel equipped with a thermometer, a stirrer, a gas inlet tube and a condenser. To 592 g. of this aromatic material was added 134 g. of paraformaldehyde and 120 g. of anhydrous zinc chloride. The reactor contents were brought up to a temperature of 60° C. with vigorous stirring. Dry hydrogen chloride gas was added through the gas inlet tube until a total of 151 g. had been added. About 147 g. of this gas was absorbed in the reaction medium. The total reaction time at 60° C. was 2 hours. The reaction mixture was then cooled and about 500 ml. of water were added. Following this, the product was extracted with about 200 ml. of ether. After separation of the extract, the extracted material was washed twice with water, once with 500 ml. of saturated sodium bicarbonate solution and two more times with water. Following this the extract was dried twice over magnesium sulfate and then the solvent was removed by distillation.

The resultant product (yield=540 g.) contained 12.76 to 12.88% chlorine. Nuclear magnetic resonance and infrared spectroscopy indicated that the product was chloromethylated.

This product (123 g.) was allowed to react with 100 g. of crude quinoline at a temperature of 125° C. in the presence of isopropanol, in a reaction procedure similar to that described above. The quaternarization reaction was carried out over a 5-hour period. Additional isopropanol was added to give a 60 weight percent solution of the mixed quaternary derivative and isopropanol.

EXAMPLE 5

A lower boiling aromatic fraction similar to that used in Example 4 above but having a flash point of about 100° F. and containing primarily $C_9$ aromatics was chloromethylated in a manner similar to that described in Example 4. a 500 g. sample of the aromatic fraction was used and a yield of 574 g. of product was obtained. Nuclear magnetic resonance and infrared spectroscopy confirmed the introduction of the chloromethyl group into the ring structure. Elemental analysis showed a chlorine content of from 16.25 to 16.31%.

A sample of 123 g. of this reaction product was allowed to react with 100 g. of crude quinoline at 125° C. for a period of about 4 hours in the presence of isopropanol. The final aromatic quaternary compound was made up as a 60% solution in isopropanol.

EXAMPLE 6

To test the quaternary aromatic compounds prepared as described above, a series of corrosion tests were carried out with 28% hydrochloric acid solutions on steel coupons. These tests were conducted by first preparing a stock (standard) corrosion inhibitor solution containing 7.5% by weight of a crude grade of 1-hexyne-3-ol, 1.0 weight percent of isooctylphenol polyethyleneoxyethanol containing from 9 to 10 mols of ethylene oxide per mol of isooctylphenol, and 91.5 weight percent of formamide. This inhibitor solution was added in a concentration of 5% by volume to each of a series of bottles containing 100 ml. of 28% hydrochloric acid solution. Samples of the polycyclic quaternary products prepared in Examples 1 through 5 and, for purposes of comparison, samples of N-benzylquinolinium chloride (60% in isopropanol) and N-octylquinolinium bromide (60% in isopropanol) were added to separate bottles in concentrations of 0.75 and 1.5% by volume, based on the acid solution. The resulting corrosion inhibition was the total effect of the stock corrosion inhibitor and the quaternary compounds.

The steel coupons used in the tests were cut from new oil field tubing. The coupons were washed with xylene and dried, tumbled in an abrasive compound to remove mill scale, and then scrubbed and acidized briefly in dilute hydrochloric acid. Following this treatment, each coupon was washed and dried and then stored in a dessicator. The coupons measured 1.38 in. long by 1.38 in. wide and retained the curvature of the pipe. Each coupon was weighed before it was used so that the amount of corrosion could be determined. The steel from which the coupons were cut was ASTM P-105 steel.

The tests were carried out by placing a weighed coupon in each of the prepared bottles containing 28% hydrochloric acid and an inhibitor composition. These bottles were then placed in an autoclave and subjected to a temperature of 325° F. and a pressure of 1000 psig for a period of 2 hours. At the end of this period, the samples were removed from the bottles, washed and dried, and then weighed to determine the weight loss. The corrosion rate in pounds per square foot of metal was calculated. The results obtained are set forth in Table I below.

TABLE I

Corrosion Tests of Quaternaries

| Test No. | Quaternary Compound | Concentration Vol. % | Corrosion Rate Lb/ft² |
|---|---|---|---|
| 1 | Quinoline-α-chloromethylnaphthalene | 0.75 | 0.0183 |
| 2 | Quinoline-α-chloromethylnaphthalene | 1.50 | 0.0543 |
| 3 | Quinoline-chloromethylated polystyrene | 0.75 | 0.140 |
| 4 | Quinoline-chloromethylated polystyrene | 1.50 | 0.167 |
| 5 | Quinoline-chloromethylated $C_9$–$C_{12}$ aromatics | 0.75 | 0.240 |
| 6 | Quinoline-chloromethylated $C_9$–$C_{12}$ aromatics | 1.50 | 0.260 |
| 7 | Quinoline-chloromethylated $C_9$ aromatics | 0.75 | 0.129 |
| 8 | Quinoline-chloromethylated $C_9$ aromatics | 1.50 | 0.187 |
| 9 | Quinoline-Benzyl Chloride | 0.75 | 0.538 |
| 10 | Quinoline-Benzyl Chloride | 1.50 | 0.359 |
| 11 | Quinoline-Octyl Bromide | 0.75 | 0.413 |

Note
All test solutions contained 5% by volume of a stock inhibitor consisting of 7.5 wt. % 1-hexyn-3-ol, 91.5 wt. % formamide and 1.0 wt. % of "TRITON X-100" (isooctylphenol polyethyleneoxyethanol).

It will be noted from the above table that the corrosion rates with the samples containing the quaternary compound prepared from quinoline and polycyclic aromatic materials were less than one-half those obtained with the quinoline-benzyl chloride and quinoline-octyl bromide compounds. The corrosion rates with the quinoline-α-chloromethyl naphthalene quaternary compounds were particularly low.

Earlier work by applicants has shown that the quinoline-benzyl chloride and quinoline-octyl bromide quaternaries are somewhat more effective than materials prepared from other aliphatic and single ring aromatic precursors.

These data thus demonstrate that, in the presence of an acetylenic alcohol, a surface active agent and a formic acid derivative, the specially selected quaternary compounds which have been prepared from quinoline and polycyclic aromatics are surprisingly much more effective than the corresponding materials prepared from aliphatic and single ring aromatic precursors.

EXAMPLE 7

Another series of tests similar to that described in Example 6 was carried out using the quinoline-$C_9$ to $C_{12}$ aromatic quaternary of Example 4, the quinoline-$C_9$ aromatic quaternary of Example 5 and, for purposes of comparison, the quinoline-benzyl chloride quaternary referred to in Example 6. These tests were carried out by preparing 100 ml. samples of 15% hydrochloric acid containing 5% by volume of the base inhibitor described in Example 6 and adding a coupon of P-105 steel to each bottle. The bottles were placed in an autoclave and subjected to a temperature of 350° F. at a pressure of 4000 psig for 2 hours. At the end of this time, the coupons were removed from the bottles, washed and dried, and weighed to permit calculation of the corrosion rate. The results are set forth in Table II below.

TABLE II

Corrosion Tests in 15% HCl

| Test No. | Quaternary Compound | Concentration Vol. % | Corrosion Rate Lb/ft² |
|---|---|---|---|
| 1 | Quinoline-chloromethylated $C_9$-$C_{12}$ Aromatics | 0.75 | 0.0425 |
| 2 | Quinoline-chloromethylated $C_9$-Aromatics | 1.50 | 0.0325 |
| 3 | Quinoline-chloromethylated $C_9$ Aromatics | 0.75 | 0.0439 |
| 4 | Quinoline-chloromethylated $C_9$ Aromatics | 1.50 | 0.0353 |
| 5 | Quinoline-benzyl Chloride | 0.75 | 0.0729 |
| 6 | Quinoline-benzyl Chloride | 1.50 | 0.0706 |

Note
All test solutions contained 5% by volume of a stock inhibitor consisting of 7.5 wt. % 1-hexyn-3-ol, 91.5 wt. % formamide and 1.0 wt. % of "TRITON X-100"

As can be seen from the above Table II, corrosion rates with the samples containing the quarternary compounds prepared from quinoline and the polycyclic aromatic materials were only a little more than about half those obtained with the quinoline-benzyl chloride quaternary. The rates with the quaternary prepared from the $C_9$ aromatics and that prepared from the $C_9$–$C_{12}$ aromatics were about the same. All of the rates were considerably lower than those in the earlier tests because of the less concentrated hydrochloric acid and higher pressure used. The corrosion rate normally decreases with increasing pressure when formic acid derivatives are employed in these tests, but this is offset to a large extent in well-treating operations by the higher temperatures which are generally encountered in deep, high pressure wells.

EXAMPLE 8

A corrosion inhibitor was formulated by blending formamide, 1-hexyn-3-ol, octylphenolpolyethyleneoxyethanol containing from 8 to 10 mols of ethylene oxide per molecule, the quinoline-α-chloromethyl naphthalene quaternary prepared as described in Example 1, and a fluorinated cationic surfactant to produce a blend having the following composition:

| Constituent | Percentage |
|---|---|
| Formamide | 50.5 wt. % |
| 1-hexyn-3-ol | 10.0 wt. % |
| Octylphenolpolyethyleneoxyethanol | 2.5 wt. % |
| Fluorinated surfactant | 0.2 wt. % |
| Quinoline-α-chloromethyl-naphthalene quaternary | 38.55 wt. % |

Samples of the above composition were added to separate bottles containing 100 ml. of 28% hydrochloric acid solution and coupons of P-105, N 80 and C 75 steel. Inhibitor concentrations of 1%, 2% and 3% by volume were used. For purposes of comparison, similar test samples containing two of the best commercially available high temperature corrosion inhibitors were also tested. These test bottles were placed in an autoclave and maintained at 275° F. and 100 psig for a period of 6 hours. The coupons were then removed from the bottles, washed and dried, and weighed for determination of the corrosion rate. The results of these tests are shown in Table III below.

TABLE III

Tests of Commercial Inhibitors and the Inhibitor of the Invention

| Inhibitor* | Concentration Vol. % | Coupon Type | Corrosion Rate, Lb/ft² |
|---|---|---|---|
| A | 3 | P 105 | 0.739 |
| A | 3 | N 80 | 0.664 |
| A | 3 | C 75 | 0.238 |
| B | 3 | C 75 | 0.0921 |
| C | 1 | P 105 | 0.276 |
| C | 1 | N 80 | 0.217 |
| C | 1 | C 75 | 0.122 |
| C | 2 | P 105 | 0.0202 |
| C | 2 | N 80 | 0.0274 |
| C | 2 | C 75 | 0.0264 |
| C | 3 | P 105 | 0.0255 |
| C | 3 | N 80 | 0.0301 |
| C | 3 | C 75 | 0.0464 |

*Inhibitor A - Commercially marketed inhibitor.
Inhibitor B - Another commercially marketed inhibitor.
Inhibitor C - Inhibitor composition of the invention.

It can be seen from the table that the inhibitor of the invention was more effective at a concentration of 1% than commercial inhibitor A was at a concentration of 3% and about twice as effective as commercial inhibitor B at a concentration of 3%. The data also demonstrate that the improved inhibitor composition of the invention can be used for the protection of various steels and, unlike commercial inhibitor A, does not show wide variations in the level of protection afforded with the three steels tested.

Under the particular test conditions employed, the inhibitor composition was most effective at a concentration between 1 and 2 volume percent, based upon the acid. The above data demonstrate that the inhibitors of the invention are surprisingly more effective that the commercial inhibitors available heretofore.

EXAMPLE 9

Further corrosion tests were carried out using the inhibitor composition of Example 8 and a base inhibitor composition prepared by blending formamide, the fluorinated cationic surfactant of Example 8, a crude 1-hexyn-3-ol and the N-(α-naphthylmethyl)quinollumo chloride of Example 1.

To separate samples of this base inhibitor composition were added three different polyethoxylated primary amines in various concentrations. Coupons of N 80 steel were placed in each of a series of test bottles containing 100 ml. of 15% hydrochloric acid containing the base inhibitor composition in a concentration of 2 volume percent.

The test bottles were placed in an autoclave and held at a temperature of 300° F. and a pressure of 4000 psig for a period of 6 hours. Each sample, after being washed and dried, was weighed to permit determination of the corrosion rate. Table IV below sets forth the results obtained.

TABLE IV

Use of Polyethoxylated Amines in Inhibitors

| Inhibitor* | Polyethoxylated Amine | Surfactant Concentration, Vol. % Based on Acid | Corrosion Rate lb/ft² |
|---|---|---|---|
| 1 | — | — | 0.149 |
| 2 | $C_{18}H_{37}-N(CH_2CH_2OH)_2$ | 0.025 | 0.0552 |
| 2 | " | 0.05 | 0.0845 |
| 2 | " | 0.10 | 0.0371 |
| 2 | $C_{18}H_{37}-N(CH_2CH_2O)_3H)_2$ | 0.025 | 0.0274 |
| 2 | " | 0.05 | 0.0275 |
| 2 | " | 0.10 | 0.0453 |
| 2 | $C_{18}H_{37}-N(CH_2CH_2O)_8H)_2$ | 0.025 | 0.360 |
| 2 | " | 0.05 | 0.0558 |
| 2 | " | 0.10 | 0.0442 |
| 2 | $C_{12}H_{25}-N(CH_2CH_2OH)_2$ | 0.025 | 0.0575 |
| 2 | " | 0.05 | 0.0296 |
| 2 | " | 0.10 | 0.0368 |

*1 - Inhibitor of Example 8 containing 50.5% formamide, 0.2% perfluoroalkylimidazoline, 1.25% polyethoxylated octyl phenol, 10.0% hexyne-1-ol-3, and 38.55% N-(αnaphthylmethyl) quinolinium chloride.

*2 - Inhibitor base containing 50.63% formamide, 0.2% perfluoroalkylimidazoline, 10.13% hexyne-1-ol-3, and 39.04% N-(α-naphthylmethyl)quinolinium chloride.

It can be seen from the data of Table IV that inclusion of the polyethoxylated amines in the inhibitor base as a surfactant instead of the polyethoxylated octyl phenol resulted in a considerably higher level of protection for the N 80 steel coupons used in the test than was obtained with the inhibitor composition of Example 8. The $C_{12}$ alkyl polyethoxylated amine was particularly effective. As a result of this, it is preferred to employ the polyethoxylated amines as the primary surface active agents in the inhibitor compositions of the invention.

EXAMPLE 10

Still another series of tests was carried out with the inhibitor blend composition of Example 8 and a composition prepared by blending 50 weight percent formamide, 0.2 weight percent of the previously described fluorinated surfactant, 10.0 weight percent of 1-hexyn-3-ol, 28.55 weight percent of the N-(α-naphthylmethyl)quinolinium chloride of Example 1 and 1.25 weight percent of a polyethoxylated $C_{18}$ alkyl primary amine containing a total of 5 ethylene oxide groups per molecule. Samples of these two inhibitor blends were added to bottles containing 100 ml. of 15% HCl in an inhibitor concentration of 2%. Coupons of P 105 and N 80 steel were placed in separate bottles containing the inhibited acid and these bottles were then placed in the autoclave and held at 300° F. and 4000 psig for 6 hours. The coupons were removed at the end of this period, washed and dried, and weighed for determination of the corrosion rate. Table V below sets forth the results.

TABLE V

Corrosion Inhibitor Tests

| Inhibitor* | Coupon | Corrosion Rate, Lb/ft² |
|---|---|---|
| 1 | P 105 | 0.0292 |
| 1 | N 80 | 0.178 |
| 2 | P 105 | 0.0589 |
| 2 | N 80 | 0.0376 |

*1 - Inhibitor of Example 8 containing 50.0% formamide, 0.2% perfluoroalkylimidazoline, 1.25% polyethoxylated octyl phenol, 10.0% 1-hexyn-3-ol, and 38.55% N-(α-naphthylmethyl)quinolinium chloride.

*2 - Inhibitor containing 50.0% formamide, 0.2% perfluoroalkylimidazoline, 10.0% hexyne-1-ol-3, 38.55% N-(α-naphthylmethyl)quinolinium chloride, and 1.25% $C_{18}$ alkyl polyethoxylated amine containing 5 ethylene oxide groups.

Although both of the inhibitors used in the tests reported above were reasonably effective under the test conditions employed, it is clear that Inhibitor 2 was more effective than the material of Example 8. This composition is therefore a particularly preferred one for the purposes of the invention.

EXAMPLE 11

The following experimental result demonstrates the importance of utilizing a polynuclear heterocyclic amine and a polynuclear quaternizing agent in formulating the corrosion inhibiting compositions of the present invention. Adducts of various heterocyclic amines were prepared with α-chloromethylnaphthalene according to the following equation and following the general procedures set forth in detail in the previous examples.

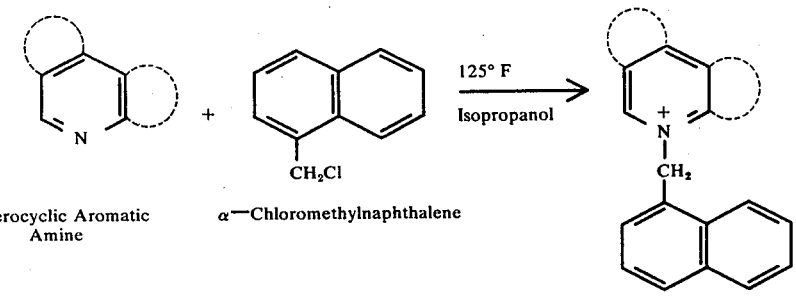

Heterocyclic Aromatic Amine

α—Chloromethylnaphthalene

Quaternary Adduct

The adducts were prepared either as a 60% solution in isopropanol if they were suitably soluble or isolated as a solid if they precipitated.

The results of two tests are summarized below in Table VI.

TABLE VI

| Test Conditions | |
|---|---|
| Temperature | 325° F |
| Acid concentration | 28% HCl |
| Pressure | 2000 psig |
| Volume of Acid | 100 ml |
| Endurance of Test | 2 hours at 325° F |
| Stirring Rate | Static |
| Stock Inhibitor (as described above) | 5% added to each test unit |
| Coupon Type | P-105 |
| Amount of Adduct Added | 1.2g/100ml for solids<br>1.5ml/100ml for solutions |

Results:

| Heterocyclic Adduct | Comment | Test Results Summary Reported in Corrosion (lb/ft²) | | |
|---|---|---|---|---|
| | | Test 1 | Test 2 | Avg. |
| N-(naphthylmethyl) quinolinium chloride | Prepared from crude grade of quinoline | 0.113 | 0.0965 | 0.105 |
| N-(naphthylmethyl) quinolinium chloride | Prepared from reagent grade quinoline | 0.316 | 0.165 | 0.240 |
| N-naphthylmethyl) (5, 6 benzoquinolinium) chloride | | 0.367 | 0.320 | 0.344 |
| N-(naphthylmethyl) acridinium chloride | | 0.0513 | 0.074 | 0.063 |
| N-(naphthylmethyl) phenanthridinium chloride | | 0.117 | 0.103 | 0.110 |
| N-(naphthylmethyl) pyridinium chloride | | 0.547 | 0.590 | 0.568 |
| Blank No.1 (No quaternary compound) | | 1.04 | 0.960 | 1.00 |
| Blank No.2 (No stock inhibitor and No quaternary compound) | | 1.08 | 1.11 | 1.10 |

The above tests demonstrate the remarkable dependence on the type of heterocyclic amine, as well as the necessity of a quaternary adduct in these types of systems. The unusual high performance of the acridine and phenanthridine adduct is unexpected. The poor performance of the pyridine adduct is also noteworthy since it strongly supports the criticality aspects of the invention.

EXAMPLE 12

The following is a hypothetical example to illustrate the use of the Supplemental Surfactant.

A. To the blend of Example 8 is added 10 wt. % of BR1J-35.

B. To the blend of Example 9 containing the $C_{12}$ alkyl polyethoxylated amine is added 10 wt. % of BR1J-35.

The fluorocarbon surfactant used in the examples is cationic and was obtained from Minnesota Mining and Manufacturing Company under the trademark "FC-134". This is a typical fluorocarbon surfactant. There are many others commercially available which will perform satisfactorily.

It should be noted that the acetylenic alcohol described above can be replaced in whole or part by the diacetylenic alcohol having the structural formula:

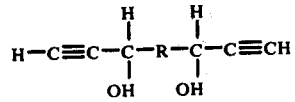

where R is an aliphatic, alicyclic or aromatic residue containing from 1 to about 12 carbon atoms and may include one or more functional groups such as halogen atoms, carbonyl, carboxyl, carbamyl, amino, formyl or nitroso radicals or other functional groups without impaired performance.

This diacetylenic alcohol is described in detail in the copending commonly assigned patent application entitled "Diacetylenic Alcohol Corrosion Inhibitors" by the same inventive entity as the instant application.

What is claimed is:

1. A corrosion inhibitor composition comprising:

1. from about 25 to about 60 weight percent of a quaternary compound of (i) a heterocyclic nitrogen base selected from the group consisting of quinoline, acridine and phenanthridine and (ii) a halomethylated polycyclic aromatic compound selected from the group consisting of halomethylated indane, indene, naphthalene, anthracene, phenanthrene, acenaphthene, fluorene, xanthene, chrysene and pyrene, halomethylated petroleum fractions containing $C_9$ to $C_{12}$ aromatic hydrocarbons, and halomethylated polystyrenes having molecular weights ranging from about 100 to about 5,000;
2. from about 5 to about 30 weight percent of an aliphatic acetylenic alcohol having the structural formula of

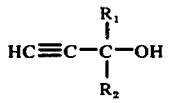

wherein $R_1$ is selected from the group consisting of hydrogen and a methyl group and $R_2$ is selected from the group consisting of hydrogen and alkyl groups containing from 1 to about 7 carbon atoms;
3. from about 0.01 to about 15 weight percent of a water-soluble surfce active agent selected from the group consisting of polyethoxylated octyl phenol and polyethoxylated amines having the structural formula of

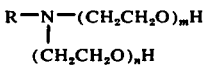

wherein R is a $C_5$ to $C_{50}$ alkyl group, and m and n are numbers ranging from 1 to about 20; and
4. from about 30 to about 75 weight percent of a formic acid derivative having the formula of

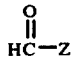

wherein Z is selected from the group consisting of an alkoxy group containing from 1 to about 4 carbon atoms, an amino radical, and an alkyl-substituted amino group containing from 1 to about 4 carbon atoms.

2. The composition of claim 1 wherein said quaternary compound in N-($\alpha$-naphthylmethyl) quinolinium chloride.

3. The composition of claim 1 wherein said surface active agent is polyethoxylated octyl phenol.

4. The composition of claim 2 wherein said surface active agent is polyethoxylated octyl phenol.

5. The composition of claim 1 wherein said acetylenic alcohol is 1-hexyn-3-ol.

6. The composition of claim 1 wherein said formic acid derivative is formamide.

7. The composition of claim 1 wherein said surface active agent is a polyethoxylated amine of the general formula

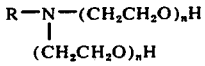

wherein R is a $C_5$ to $C_{50}$ alkyl group and *n* is a number of between 1 to 20.

8. The composition of claim 1 which contains from 6 to 14 weight percent of a supplementary surfactant comprising the reaction product of lauryl alcohol with about 20 to 23 moles of ethylene oxide.

9. The composition of claim 1 wherein said quaternary compound is N-($\alpha$-naphthylmethyl) quinolinium chloride, said acetylenic alcohol is hexyne-1-ol-3 and said formic acid derivative is formamide.

10. The composition of claim 9 wherein said surface active agent is polyethoxylated octyl phenol.

11. The composition of claim 1 wherein said heterocyclic nitrogen base is acridine.

12. The composition of claim 1 wherein said heterocyclic nitrogen base is phenanthridine.

13. The composition of claim 1 wherein said surface active agent is selected from the group consisting of polyethoxylated amines having the structural formula of:

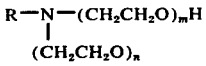

wherein R is a $C_{12}$ to $C_{18}$ alkyl group, and m and n are numbers ranging from 1 to about 8.

14. A corrosion inhibitor composition comprising:
1. from about 25 to about 60 weight percent of a quaternary compound of (i) a heterocyclic nitrogen base selected from the group consisting of acridine and phenanthridine and (ii) a halomethylated polycyclic aromatic compound selected from the group consisting of halomethylated indane, indene, naphthalene, anthracene, phenanthrene, acenaphthene, fluorene, xanthene, chrysene and pyrene, halomethylated petroleum fractions containing $C_9$ to $C_{12}$ aromatic hydrocarbons, and halomethylated polystyrenes having molecular weights ranging from about 100 to about 5,000;
2. from about 5 to about 30 weight percent of an aliphatic acetylenic alcohol having the structural formula of

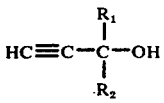

wherein $R_1$ is selected from the group consisting of hydrogen and a methyl group, and $R_2$ is selected from the group consisting of hydrogen and alkyl groups containing from 1 to about 7 carbon atoms;
3. from about 0.01 to about 15 weight percent of a water-soluble surface active agent selected from the group consisting of polyethoxylated amines having the structural formula of

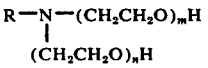

wherein R is a $C_{12}$ to $C_{18}$ alkyl group, m and n are numbers ranging from 1 to about 8; and
4. from about 30 to about 75 weight percent of a formic acid derivative having the formula of

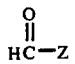

wherein Z is selected from the group consisting of an alkoxy group containing from 1 to about 4 carbon atoms, an amino radical and an alkyl-substituted amino group containing from 1 to about 4 carbon atoms.

15. The composition of claim 14 wherein said heterocyclic nitrogen base is acridine.

16. The composition of claim 15 wherein said quaternary compound is N-(naphthylmethyl)-acridinium chloride.

17. The composition of claim 14 wherein said heterocyclic nitrogen base is phenanthridine.

18. The composition of claim 17 wherein said quaternary compound is N-(naphthylmethyl)-phenanthridinium chloride.

19. The composition of claim 14 wherein said surface active agent is a polyethoxylated amine having the structural formula of:

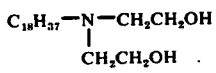

20. The composition of claim 14 wherein said surface active agent is a polyethoxylated amine having the structural formula of:

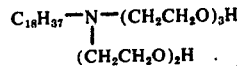

21. The composition of claim 14 wherein said surface active agent is a polyethoxylated amine having the structural formula of:

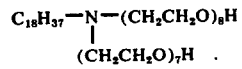

22. The composition of claim 14 wherein said surface active agent is a polyethoxylated amine having the structural formula of:

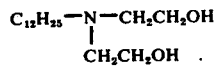

* * * * *